US006764132B1

(12) United States Patent
Gaertner

(10) Patent No.: US 6,764,132 B1
(45) Date of Patent: Jul. 20, 2004

(54) CHAIR WITH INTEGRATED, RETRACTABLE CARRY STRAP

(76) Inventor: William L. Gaertner, 231K Parkway Dr., Williamsburg, VA (US) 23185

( * ) Notice: Subject to any disclaimer, the term of this patent is extended or adjusted under 35 U.S.C. 154(b) by 0 days.

(21) Appl. No.: 10/436,569

(22) Filed: May 13, 2003

Related U.S. Application Data

(60) Provisional application No. 60/378,040, filed on May 15, 2002.

(51) Int. Cl.[7] ..... A47C 31/00

(52) U.S. Cl. ..... 297/183.5; 297/130; 297/16.1; 297/16.2; 297/17; 297/224; 297/155

(58) Field of Search ..... 297/17, 19, 27, 297/28, 31, 129, 130, 183.45; 224/155, 153

(56) References Cited

U.S. PATENT DOCUMENTS

| | | | | |
|---|---|---|---|---|
| 2,638,970 A | | 5/1953 | Harber | |
| 4,489,866 A | | 12/1984 | Korte | |
| 4,577,901 A | * | 3/1986 | Phillips | 297/17 |
| 4,676,548 A | | 6/1987 | Bradbury | |
| 5,139,308 A | | 8/1992 | Ziman | |
| 5,409,291 A | | 4/1995 | Lamb et al. | |
| 5,501,505 A | * | 3/1996 | Jablonski | 297/4 |
| 5,527,088 A | | 6/1996 | MacLean | |
| 5,536,064 A | | 7/1996 | MacLean | |
| 5,538,318 A | | 7/1996 | MacLean | |
| 5,588,696 A | | 12/1996 | Jay et al. | |
| 5,611,594 A | * | 3/1997 | Findlay | 297/28 |
| 5,988,737 A | | 11/1999 | Tomaiuolo | |
| 6,048,023 A | | 4/2000 | Lampton | |
| 6,056,172 A | | 5/2000 | Welsh | |
| 6,095,599 A | | 8/2000 | Lambert | |
| 6,502,899 B2 | * | 1/2003 | Tseng | 297/28 |

* cited by examiner

*Primary Examiner*—Peter M. Cuomo
*Assistant Examiner*—Erika Garrett
(74) *Attorney, Agent, or Firm*—Kaufman & Canoles

(57) ABSTRACT

A collapsible chair having a sling that may be used as a carry strap. When the collapsible chair is in an opened configuration, the sling retracts out of the way, but when the collapsible chair is in a closed or collapsed configuration, the sling can be pulled out and slung over the user's shoulder as a carry strap. When the collapsible chair is in the collapsed configuration, and the sling is extended, tension on the sling assists in maintaining the chair in the collapsed position.

20 Claims, 8 Drawing Sheets

CHAIR WITH INTEGRATED, RETRACTABLE CARRY STRAP

CROSS-REFERENCE TO RELATED APPLICATIONS

This application claims the benefit of U.S. Provisional No. 60/378,040 filed May 15, 2002, the entire disclosure of which is incorporated herein by reference.

BACKGROUND OF THE INVENTION

Field of Invention

This invention relates generally to the field of chairs having an integrated carry strap.

BRIEF SUMMARY OF THE INVENTION

The improved collapsible chair according to this invention is similar to conventional, folding beach chairs. However, the improved collapsible, folding chair includes a sling that may be used as a carry strap. When the collapsible chair is in an opened configuration, the sling retracts out of the way, but when the collapsible chair is in a closed or collapsed configuration, the sling can be pulled out and slung over the user's shoulder as a carry strap. Additionally, when the collapsible chair is in the collapsed configuration, and the sling is pulled out, tension on the sling assists in maintaining the collapsible chair in the collapsed position.

BRIEF DESCRIPTION OF THE DRAWINGS

Exemplary embodiments of this inventions will be described in detail, with reference to the following figures, wherein like reference numerals refer to like parts throughout the several views, and wherein.

DETAILED DESCRIPTION OF PREFERRED EMBODIMENTS

For simplicity and clarification, the operating principles, design factors, and layout of the collapsible chair according to this invention are explained with reference to various exemplary embodiments of the collapsible chair according to this invention. The basic explanation of the collapsible chair is applicable for the understanding and design of the constituent components comprising the collapsible chair of this invention For simplicity and clarification, the operating principles, design factors, and layout of the collapsible chair having an integrated, retractable carry strap according to this invention are explained with reference to various exemplary embodiments of the collapsible chair according to this invention. The basic explanation of the collapsible chair is applicable for the understanding and design of the constituent components comprising the collapsible chair of this invention.

Figure 1:
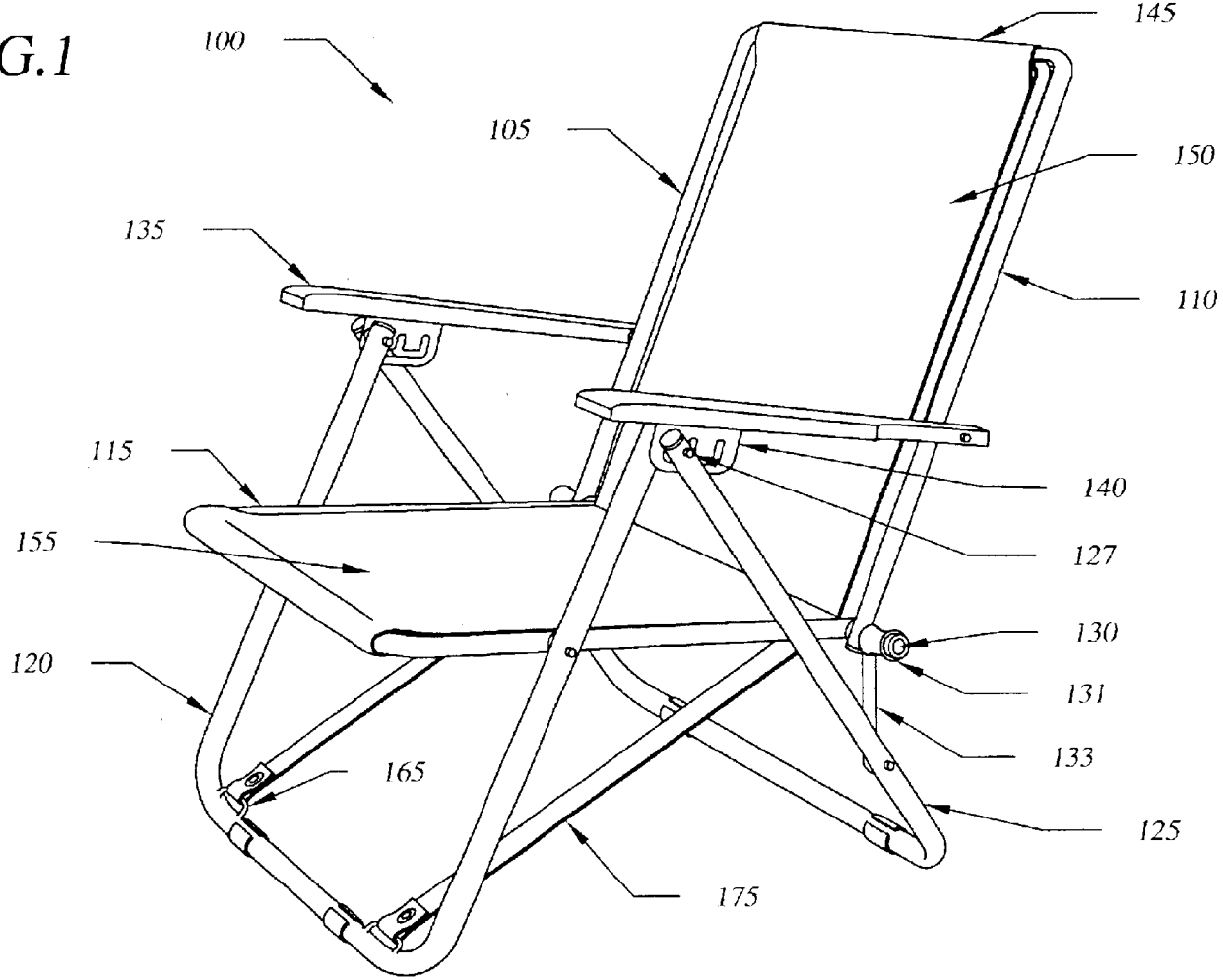
FIG. 1 shows a front perspective view of a first exemplary embodiment of a collapsible chair having an integrated, retractable carry strap according to this invention.
Figure 2:
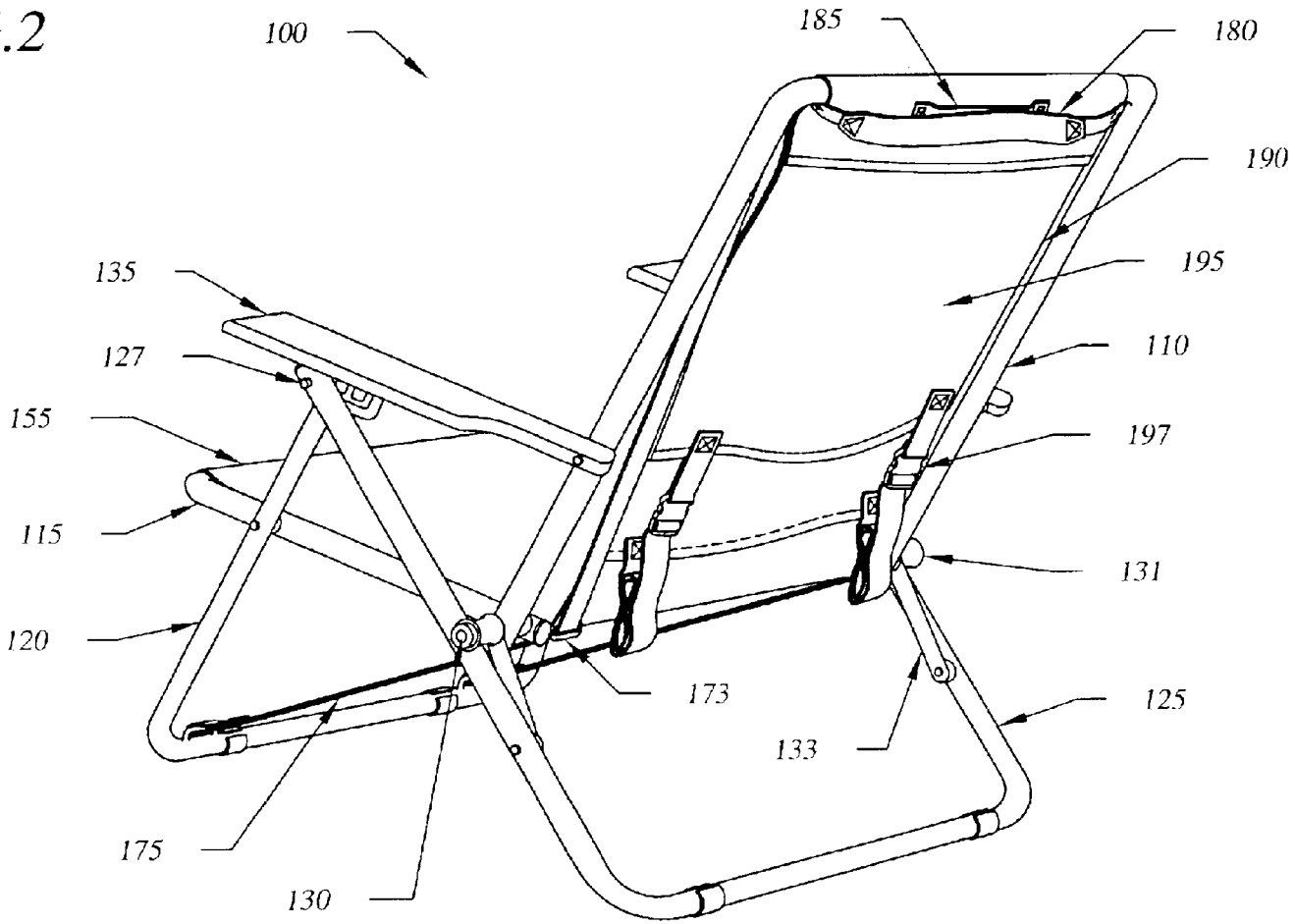
FIG. 2 shows a rear perspective view of the first exemplary embodiment of the collapsible chair according to this invention.
Figure 3:
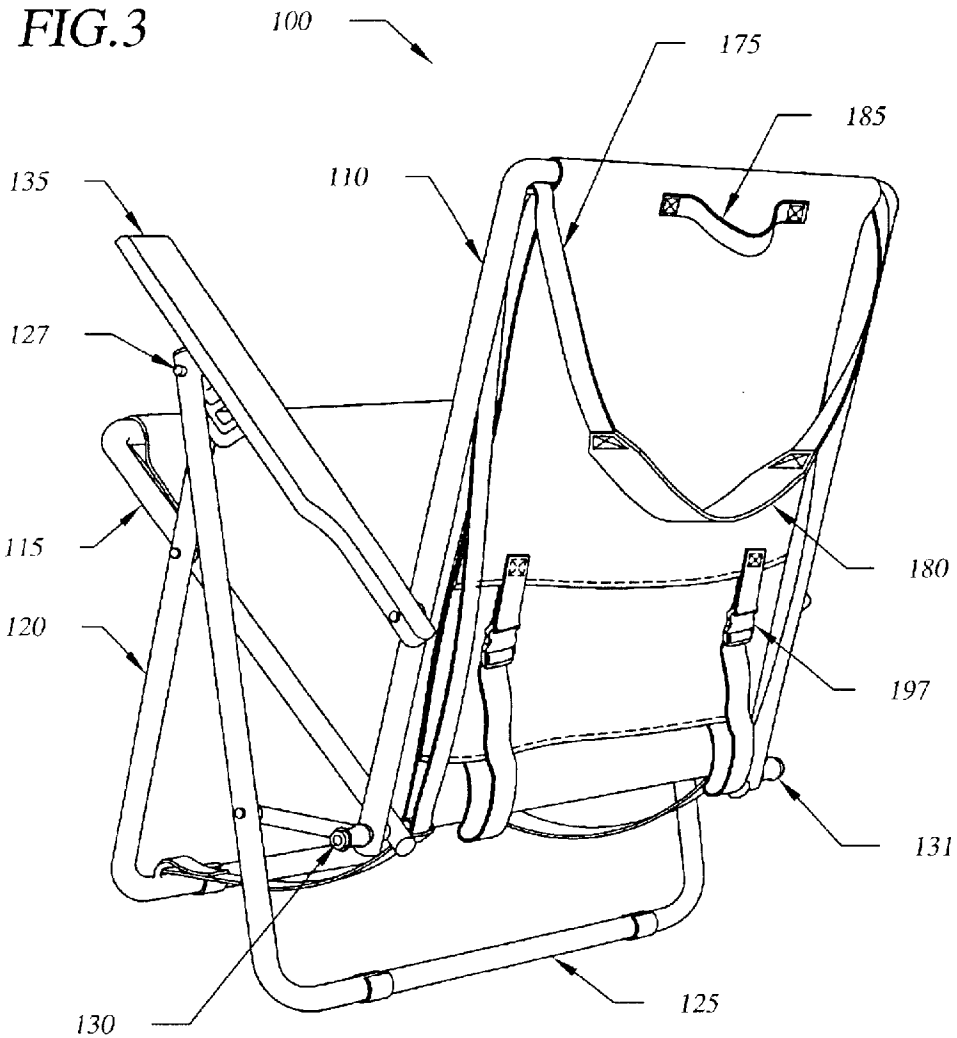
FIG. 3 shows a rear perspective view of the first exemplary embodiment of the collapsible chair according to this invention, wherein the collapsible chair is in a partially collapsed state.
Figure 4:
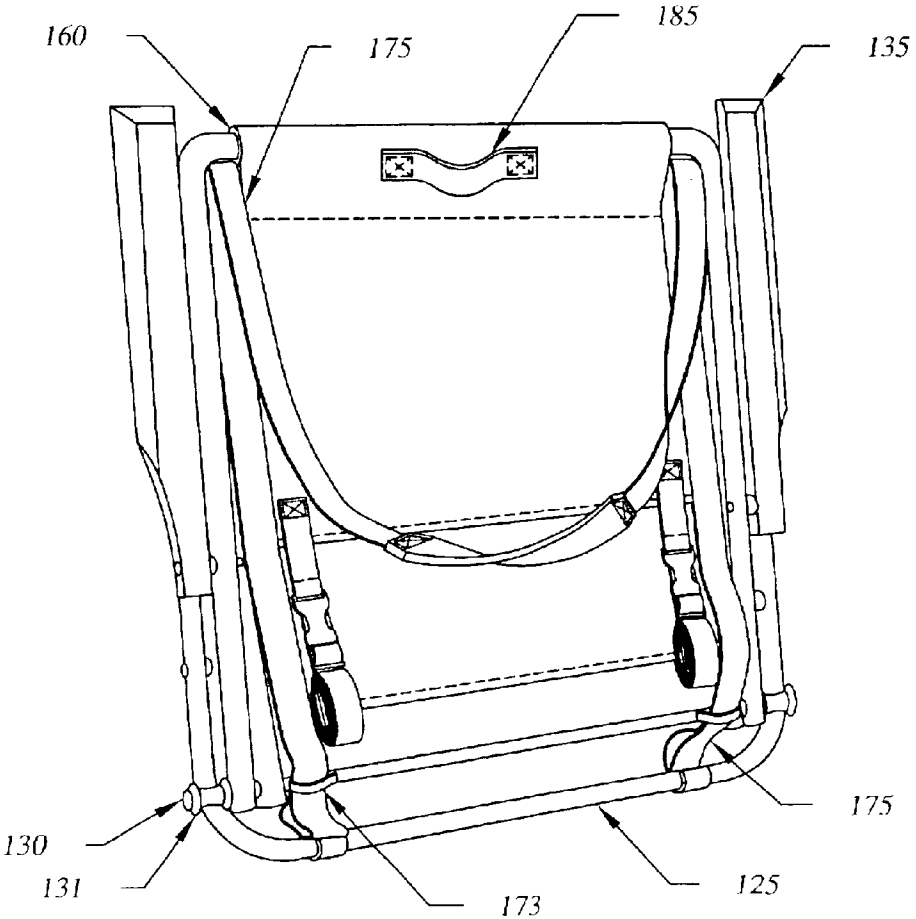
FIG. 4 shows a rear perspective view of the first exemplary embodiment of the collapsible chair according to this invention, wherein the collapsible chair is in a fully collapsed state.
Figure 5:
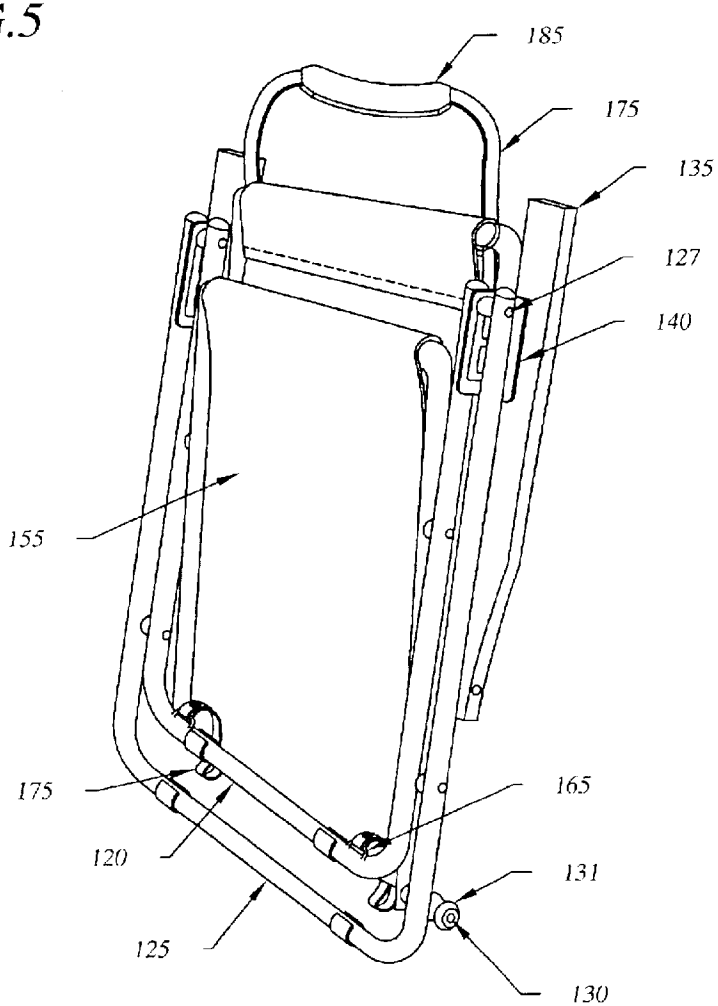
FIG. 5 shows a front perspective view of the first exemplary embodiment of the collapsible chair according to this invention, wherein the collapsible chair is in a fully collapsed state.
Figure 6:
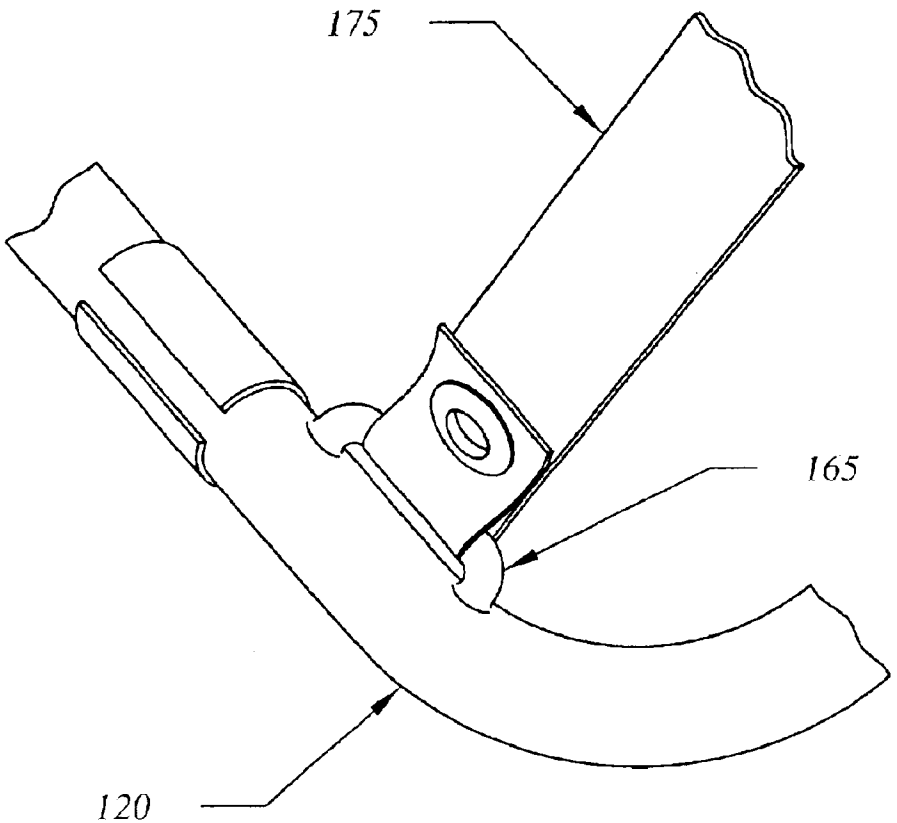
FIG. 6 shows an enlarged view of an exemplary strap attachment according to this invention.
Figure 7:
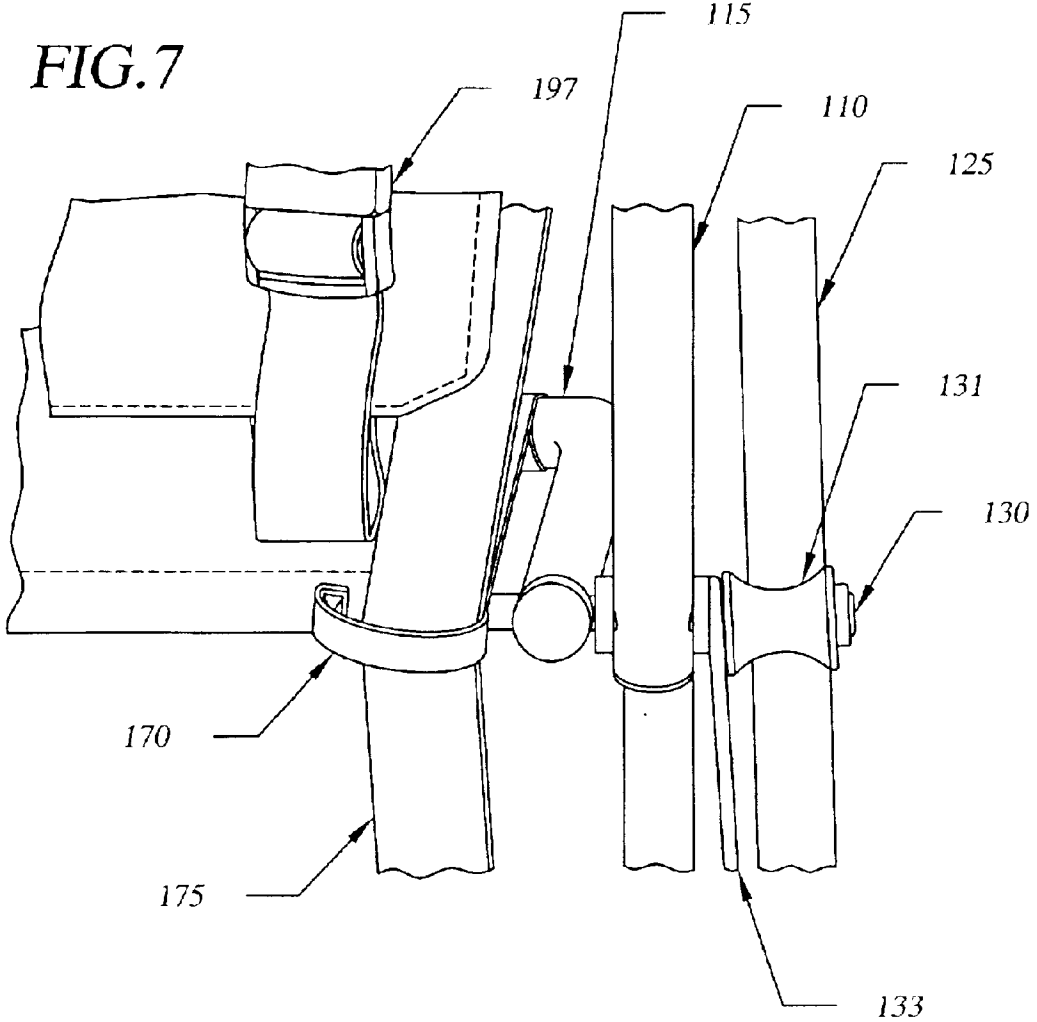
FIG. 7 shows an enlarged view of a first exemplary embodiment of a seat strap guide according to this invention.
Figure 8:
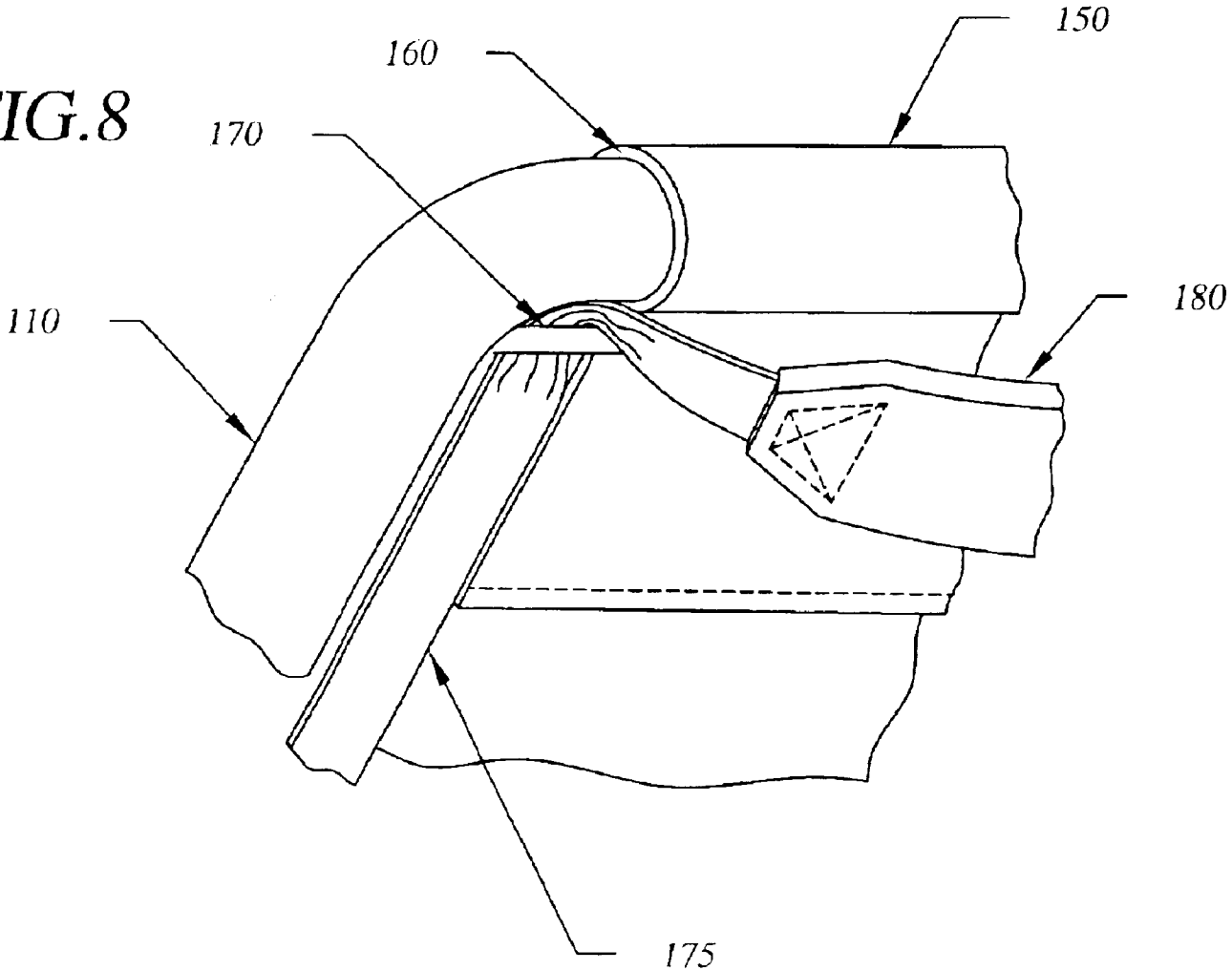
FIG. 8 shows an enlarged view of a first exemplary embodiment of a frame strap guide according to this invention.

The accompanying drawing figures show one exemplary embodiment of the collapsible chair having an integrated, retractable carry strap 100 according to this invention. FIGS. 1 and 2 show the collapsible chair 100 in an opened state, FIG. 3 shows the collapsible chair 100 in a partially collapsed state, and FIGS. 4 and 5 show the collapsible chair 100 in a fully collapsed state. In the collapsed state, the collapsible chair 100 may be more easily carried by a user.

As shown in FIGS. 1–8, the collapsible chair 100 includes at least some of a frame 105, a back frame 110, a bottom frame 115, a front support leg 120, a rear support leg 125, a pair of leg cross-members 127, a frame cross-member 130, a pair of leg supports 131, a pair of frame brace members 133, a pair of arm rests 135, a pair of position adjustment plates 140, a seat panel 145, a back panel portion 150, a bottom panel portion 155, at least one frame cushion element 160, at least one strap attachment 165, at least one frame strap guide 170, at least one seat strap guide 173, a carry strap 175, a carry strap cushion element 180, a carry handle 185, a storage compartment 190, a storage compartment flap 195, and a storage compartment flap closure means 197.

The frame 105 is made of a material, such as, for example, aluminum, aluminum alloy, or other metal alloy, steel, or steel alloy, plastic, wood, or other composite material. In various exemplary embodiments, each portion of the frame 105, as further described herein, may be solid or tubular in construction. The frame 105 includes the back frame 110 pivotally coupled, via the frame cross-member 130, to the bottom frame 115. Thus, the back frame 110 and the bottom frame 115 are rotatable about the frame cross-member 130. The frame cross-member 130 is a rod that extends beyond the width of the back frame 110 such that the pair of leg supports 131 can be secured to the ends of the frame cross-member 130.

In various exemplary embodiments, the pair of leg supports 131 is configured to contact the rear support leg 125 when the collapsible chair 100 is in an opened state.

The frame 105 also includes the front support leg 120 coupled, via the pair of leg cross-members 127, to the rear support leg 125. Thus, the front support leg 120 and the rear support leg 125 are rotatable about the pair of leg cross-members 127. The pair of leg cross-members 127 is, for example, rods, cylindrical rivets, screws, bolts, or other suitable fasteners.

The front support leg 120 is also rotatably coupled to the bottom frame 115. In various exemplary embodiments, the front support leg 120 is also rotatably coupled to the bottom frame 115 at point between the ends and the apex of front support leg 120 and the ends and apex of bottom frame 115.

In various exemplary embodiments, the width of the back frame 110 and the front support leg 120 are substantially similar, while the bottom frame 115 and the rear support leg 125 have different widths. In certain exemplary embodiments, the rear support leg 125 is the widest, followed by the back frame 110 and the front support leg 120 (both having substantially similar widths), and finally, the bottom frame 115. In this manner, in a collapsed state, each of the components of the frame 105 is substantially parallel and adjacent to one another.

The frame 105 further includes the pair of arm rests 135. The pair of arm rests 135 are pivotally coupled to the back frame 110 and adjustably coupled, via the pair of position adjustment plates 140, to the front support leg 120 and the rear support leg 125. In this manner, a user is able to alter the position of the back frame 110 relative to the bottom frame 115. Such adaptability and selectable positioning of the back frame 110 relative to the bottom frame 115 is known in the art.

It should be appreciated that, in various exemplary embodiments, the arm rests arc pivotally coupled to the front support leg 120 and the rear support leg 125. In these exemplary embodiments, the back frame 110 is not adjustable relative to the bottom frame 115.

The pivotal, and possibly adjustable, coupling of the pair of arm rests 135, allows the pair of arm rests 135 to rotated such that when the collapsible chair 100 is in a collapsed state, the pair of arm rests 135 are adjacent and substantially parallel to back frame 110.

In various exemplary embodiments, the arm rests are made of a material such as, for example, aluminum, aluminum alloy, or other metal alloy, steel, or steel alloy, plastic, wood, or other composite material.

The seat panel 145 includes the back panel portion 150 and the bottom panel portion 155, and is attached, either permanently, semi-permanently, or temporarily to the frame 105, so as to provide support to a user seated within the collapsible chair 100.

More specifically, the back panel portion 150 of the seat panel 145 is attached about or around the back frame 110 and the frame cross-member 130, while the bottom panel portion 155 of the seat panel 145 is attached about or around the bottom frame 115 and the frame cross-member 130.

The seat panel 145 may be attached about or around the frame 105 by looping the seat material, for example, over the apex of the back frame 110 and sewing the looped portion to a back side of the back panel portion 150. A similar sewing procedure may be used to couple the bottom panel portion 155 to the apex of the bottom frame 115. The seat panel 145 is also coupled to the frame cross-member 130 in a similar manner. The attachment method provides sufficient tension to the seat panel 145 to allow an average user of the collapsible chair 100 to be supported by the collapsible chair 100.

The back panel portion 150 and the bottom panel portion 155 may be part of a continuous piece of material or may be separate pieces of material. In various exemplary embodiments, the seat panel 145 is made of a fabric or other material, such as nylon, spandex, neoprene, canvas, polyester, or the like. The material may be of a porous, non-porous, or net design.

It should be appreciated that the material used to construct the back panel portion 150 may be the same as the material used to construct the bottom panel portion 155. Alternatively, the material used to construct the back panel portion 150 may be different from the material used to construct the bottom panel portion 155.

Optionally, the collapsible chair 100 may include the at least one frame cushion element 160. The frame cushion element(s) 160 are typically an element, such as, for example a polystyrene foam or other foam, which covers at least a portion of the frame 105 so as to provide a level of cushion or padding between the frame 105 and the seat panel 145. Other cushion element(s) (not shown) may be present to provide additional cushion or padding to the seat panel 145.

In various exemplary embodiments, the storage compartment 190 is formed on the back side of the back panel portion 150. In various exemplary embodiments, the[]storage compartment 190 is made of the same material as the back panel portion 150. Alternatively, the storage compartment 190 may be made of a material different from the material of the back panel portion 150, such as, for example, flexible webbing. The storage compartment 190 may be constructed to include pleats, thereby allowing the storage compartment 190 to expand outwardly from the back panel portion 150.

In various exemplary embodiments, the storage compartment 190 includes the storage compartment flap 195, which is capable of being extended over and overlying the opening defined by the storage compartment 190, allowing the storage compartment 190 to be closed. The storage compartment flap 195 may be detachably coupled to the storage compartment 190 by the storage compartment flap closure means 197. In various exemplary embodiments, the storage compartment flap closure means 197 comprises releasable fasteners such as male/female snap-release buckles, Velcro or other hook-and-loop fasteners, a ziplock fastening device, a zipper, buttons, snaps, or other fastening or closure means known by those skilled in the art, connected or coupled to each of the storage compartment 190 and the storage compartment flap 195.

Optionally, the at least one carry handle 185 is also included. As shown in the accompanying drawing figures, the carry handle 185 is fixedly attached to the back panel portion 150, substantially along the apex of the back frame 110. The carry handle 185 may be made of a webbing or other material.

As further shown in FIGS. 1–8, the collapsible chair 100 also includes the carry strap 175. The carry strap 175 is made of a webbing, cord, rope, or other material and is coupled to or about the front support leg 120, by at least one strap attachment 165, along the apex of the front support leg 120. In various exemplary embodiments, the at least one strap attachment 165 includes two looped anchors attached along the apex of the front support leg 120. Each end of the carry strap 175 is attached to a looped anchor by looping an end of the carry strap 175 through the looped anchor and attaching the looped portion to the carry strap 175 by riveting, grommeting, or sewing the looped portion to the carry strap 175.

Alternatively, the at least one strap attachment 165 includes an elongated hole formed through the front support leg 120. Each end of the carry strap 175 is attached by looping an end of the carry strap 175 through the elongated hole and attaching the looped portion to the carry strap 175 by riveting, grommeting, or sewing the looped portion to the carry strap 175.

In still other exemplary embodiments, the at least one strap attachment 165 includes an attachment area along the apex of the front support leg 120 where each end of the carry strap 175 is attached by looping an end of the carry strap 175 around the front support leg 120, in one of the two attachment areas, and attaching the looped portion to the carry strap 175 by riveting, grommeting, or sewing the looped portion to the carry strap 175.

It should be appreciated that the carry strap 175 does not have to be looped around the front support leg 120, but may be attached directly to the front support leg 120.

Optionally, the collapsible chair 100 also includes the at least one frame strap guide 170 and/or the at least one seat strap guide 173. In various exemplary embodiments, the at least one frame strap guide 170 and/or the at least one seat strap guide 173 comprise a looped anchor. The at least one frame strap guide 170 and/or the at least one seat strap guide 173 may take any geometric shape, and provide a areas on the collapsible chair 100, through which the carry strap 175 is passed, such that the carry strap 175 can be maintained in a given configuration on the collapsible chair 100.

The looped anchor may take any geometric shape, and is attached to the seat panel 145 or the frame 105. In various exemplary embodiments, the looped anchor is made of, for example, aluminum, aluminum alloy, or other metal alloy, steel, or steel alloy, plastic, wood, or other composite material. Alternatively, the looped anchor is made of, for example, fabric or other material, such as nylon, spandex, neoprene, canvas, polyester, or the like. The material may be of a porous, non-porous, or net design.

As shown in the attached drawing figures, at least one steel looped anchor may be attached in the corner sections of the back frame 110 of the frame 105, and at least one fabric looped anchor may be attached along the portion of the seat panel 145 that covers the frame cross-member 130. However, it should be appreciated that, in various other exemplary embodiments, at least one fabric looped anchor may be attached on the back side of the back panel portion 150, and at least one steel looped anchor may be attached along the portion of the frame cross-member 130.

The path that the carry strap 175 takes from a strap attachment 165, through a seat strap guide 173, through one frame strap guide 170, through a second frame strap guide 170, through another seat strap guide 173, and finally to another strap attachment 165, allows the carry strap 175 to retract out of the way when the collapsible chair is in an opened state (as shown in FIGS. 1 and 2). When the collapsible chair 100 is in a partially collapsed or collapsed state (as shown in FIG. 3 and FIGS. 4 and 5), the carry strap 175 can be pulled out and slung over the user's shoulder. Additionally, when the collapsible chair 100 is in the collapsed configuration, and the carry strap 175 is pulled out, tension on the carry strap 175 assists in maintaining the collapsible chair 100 in the collapsed position.

In various exemplary embodiments, the carry strap 175 includes an additional length of strap material (not shown) and a buckle (not shown), such that the length of the carry strap 175 may be adjusted through the buckle (not shown).

In various exemplary embodiments, the carry strap 175 includes the carry strap cushion element 180. The carry strap cushion element 180, which is made of, for example, a polystyrene foam, is included to serve as a cushion to the shoulder of a user when the collapsible chair 100 is carried by the user.

In various exemplary embodiments, the carry strap 175 may comprise a cord, rope, or strap material that may be at least partially enclosed or concealed within the frame 105 of the collapsible chair 100. For example, the carry strap 175 may take a path from a strap attachment 165, through a first opening (not shown) in the back frame 110, through a hollow portion or cavity (not shown) of the back frame 110, through a second opening (not shown) in the back frame 110, through a third opening (not shown) in the back frame 110, through a hollow portion or cavity (not shown) of the back frame 110, through a fourth opening (not shown) in the back frame 110, and finally to another strap attachment 165.

While this invention has been described in conjunction with the exemplary embodiments outlined above, it is evident that many alternatives, modifications, variations, and/or adaptations will be apparent to those skilled in the art. Therefore, such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A collapsible chair comprising:

a frame having a back fame pivotally coupled, via a frame cross-member, to a bottom frame, wherein the back frame is pivotally coupled near a fist and a second back frame end, via the frame cross-member, near a first and a second bottom frame end of the bottom frame, a front support leg pivotally coupled to the bottom frame at point between the ends and the apex of front support leg and the ends and apex of bottom frame, and pivotally coupled, via a pair of leg cross-members, to a rear support leg, wherein the front support leg is pivotally coupled near a fit and a second front support leg end, via the pair of leg cross-members, near a first and a second rear support leg end, the frame capable of being collapsed such that the back frame, the bottom frame, the front support leg, and the rear support leg collapse substantially parallel and adjacent to one another, a pair of arm rests pivotally coupled to the back frame and pivotally coupled near the cad of the front support leg and the end of the rear support leg, the pair of arm rests capable of rotating such that when the collapsible chair is in a collapsed state, the pair of arm rests are positioned adjacent and substantially parallel to the back frame;

a seat panel to provide support to a user, wherein the seat panel includes a back panel portion coupled between the back frame and the frame cross-member, and a bottom panel portion, coupled between the frame cross-member and the bottom frame;

a carry strap having a first end and a second end, wherein th first end of the carry strap is coupled, via a first strap attachment, about the front support leg, along an apex of the front support leg, the carry strap is positioned trough a first seat strap guide, through a first frame strap guide, through a second frame strep guide, through a second seat strap guide, and finally is coupled, via a second strap attachment, about the front support leg, along an apex of the font support leg, such that the carry strap ray retract when the collapsible chair is in an opened state and may be extended when the collapsible chair is in a partially collapsed or collapsed state, such that when the collapsible chair is in the partially collapsed or collapsed state, tension on the carry strap assists in maintaining the collapsible chair in the partially collapsed or collapsed state.

2. The collapsible chair of claim 1, wherein the frame comprises a material selected from one of aluminum, aluminum alloy, metal alloy, steel, steel alloy, plastic, wood, and composite material.

3. The collapsible chair of claim 1, wherein the width of the back frame and the front support leg are substantially similar, and the width of Me bottom frame and the rear support leg are different.

4. The collapsible chair of claim 1, wherein each of the back fame, the front support leg, the bottom frame, and the rear support leg has a different width.

5. The collapsible chair of claim 1, wherein the width of the rear support leg is greater than each of the width of the back frame the width of the front support leg, and the width of the bottom frame.

6. The collapsible chair of claim 1, further including a pair of leg supports secured near a first and a second end of the frame cross-member and the rear support leg, wherein the pair of leg supports is configured to contact the rear support leg when the collapsible chair is in an opened state.

7. The collapsible chair of claim 1, wherein the pair of arm rests are adjustably coupled, via a pair of position adjustment plates, near the ends of the front support leg and the rear support leg, such that a position of the back Same relative to the bottom frame may be adjusted.

8. The collapsible chair of claim 1, wherein the pair of leg cross-members comprise one of rods, cylindrical rivets, screws, bolts, and fasteners.

9. The collapsible chair of claim 1, where each end of the carry strap is coupled directly to the front support leg.

10. The collapsible chair of claim 1, wherein each strap attachment comprises a looped anchor attached along the apex of the front support leg.

11. The collapsible chair of claim 1, wherein each strap attachment comprises an elongated hole formed hugh the front support leg.

12. The collapsible chair of claim 1, wherein each strap attachment comprises an attachment am along the apex of the front support log.

13. The collapsible chair of claim 1, wherein each scat strap guide comprises a looped anchor through which the car strap is passed, such that the carry strap may be maintained in a given configuration on the collapsible chair.

14. The collapsible chair of claim 1, wherein each frame strap guide comprises a looped anchor attached to the back frame.

15. The collapsible chair of claim 1, wherein the carry strap is at least partially enclosed or concealed within the frame.

16. The collapsible chair of claim 1, wherein the carry strap includes the carry strap cushion element.

17. The collapsible chair of claim 1, wherein a length of the carry strap is adjustable.

18. The collapsible chair of claim 1, further including a storage compartment formed on a back side of the back panel portion.

19. The collapsible chair of claim 18, further including a storage compartment flap coupled to the back side of the back panel portion, which is capable of being extended over an opening defined by the storage compartment the, storage compartment flap having storage compartment flap closure means to detachably couple the storage compartment flap to the storage compartment.

20. A collapsible chair comprising:

a frame having a back frame pivotally coupled at its ends, via a frame cross-member, to the ends of a bottom fire, a front support leg pivotally coupled to the bottom frame at point between the ends and the apex of front support leg and the ends and apex of bottom frame, and pivotally coupled at its ends, via a pair of leg cross-members, to the ends of a rear support leg the Same capable of being collapsed such that the back frame, the bottom frame, the front support leg, and the rear support leg collapse substantially parallel and adjacent to one another;

a pair of arm rests, each having a plurality of adjustment positions, pivotally coupled to the back frame and pivotally coupled near the end of the front support leg and the end of the rear support leg the pair of arm rests capable of rotating such that when the collapsible chair it in a collapsed state, the pair of arm rests are positioned adjacent and substantially parallel to the back frame;

a seat panel to provide support to a user, wherein the seat panel is attached about the back frame, the frame cross-member, and the bottom frame;

a carry strap having a first end and a second end, wherein the first end of the carry strap is coupled, via a first strap attachment, about the front support leg, along an apex of the front support leg, the carry strap is positioned through a first seat strap guide, through a first frame strap guide, through a second frame strap guide, through a second seat strap guide, and finally is coupled, via a second strap attachment about the front support leg, along an apex of the front support leg, such that the carry strap may retract when the collapsible chair is in an opened state and may be extended when the collapsible chair is in a partially collapsed or collapsed state, such that when the collapsible chair is in the partially collapsed or collapsed state, tension on the carry strap assists in maintaining the collapsible chair in the partially collapsed or collapsed state.

* * * * *